US008362380B2

(12) United States Patent
Almgren et al.

(10) Patent No.: US 8,362,380 B2
(45) Date of Patent: Jan. 29, 2013

(54) CURRENT ISOLATION CONTACTOR

(75) Inventors: Ake Almgren, Sequim, WA (US); Antonio Reis, Modesto, CA (US); Ilya Pritsker, Breinigsville, PA (US); Gregory Earle, Jr., Nazareth, PA (US)

(73) Assignee: Bren-Tronics Batteries International, L.L.C., Commack, NY (US)

( * ) Notice: Subject to any disclaimer, the term of this patent is extended or adjusted under 35 U.S.C. 154(b) by 0 days.

(21) Appl. No.: 13/017,132

(22) Filed: Jan. 31, 2011

(65) Prior Publication Data

US 2012/0048699 A1 Mar. 1, 2012

(51) Int. Cl.
*H01H 5/00* (2006.01)

(52) U.S. Cl. ..... 200/468

(58) Field of Classification Search ..... 200/468, 200/82 D, 43.01, 43.07, 43.04, 43.08, 533, 200/573, 17 R; 439/180, 187, 700
See application file for complete search history.

(56) References Cited

U.S. PATENT DOCUMENTS

| | | | | |
|---|---|---|---|---|
| 2,899,511 | A * | 8/1959 | Fraser | 200/61.81 |
| 3,264,438 | A | 8/1966 | Gay | |
| 4,050,122 | A | 9/1977 | Turner | |
| 4,149,093 | A | 4/1979 | D'Alessio | |
| 4,306,126 | A | 12/1981 | Howard | |
| 5,420,385 | A | 5/1995 | Cooper | |
| 5,665,947 | A * | 9/1997 | Falcon | 200/61.18 |
| 5,713,765 | A * | 2/1998 | Nugent | 439/700 |
| 5,818,121 | A | 10/1998 | Krappel et al. | |
| 6,107,581 | A | 8/2000 | Tanigawa et al. | |
| 6,445,563 | B1 | 9/2002 | Endo | |
| 7,116,078 | B2 | 10/2006 | Colombo | |
| 7,253,584 | B2 | 8/2007 | Souther et al. | |
| 7,332,989 | B2 | 2/2008 | Jones | |
| 7,633,029 | B2 | 12/2009 | Komori et al. | |
| 7,667,149 | B2 | 2/2010 | Komori et al. | |
| 2008/0197001 | A1 | 8/2008 | Schloms et al. | |
| 2009/0194405 | A1 | 8/2009 | Poyner et al. | |

* cited by examiner

*Primary Examiner* — Edwin A. Leon
(74) *Attorney, Agent, or Firm* — Keusey & Associates, P.C.

(57) ABSTRACT

A current isolation contactor includes a first contact, a second contact movable between an engaged position with the first contact and a disengaged position away from the first contact, and a cam being movable between a biased position wherein the second contact is in the engaged position with the first contact and an unbiased position wherein the second contact is able to move to the disengaged position away from the first contact. A retaining pin retains the cam in the biased position. A drive system is operatively associated with retaining pin to move the retaining pin, allowing the cam to rotate to the unbiased position such that the second contact is moved to the disengaged position.

15 Claims, 8 Drawing Sheets

CURRENT ISOLATION CONTACTOR

FIELD OF INVENTION

The present invention relates to an electrical contactor for an electrical system that automatically breaks contact and electrically separates a power supply from a powered device when a critical event occurs.

BACKGROUND OF THE INVENTION

For a wide range of applications of lithium ion batteries, a mechanism for isolating large current loads is useful to protect both the batteries and the powered device resulting from the occurrence of a critical event. Exemplary critical events may include a reversal of polarity when the terminals of the battery are connected backwards, a short circuit resulting from positive and negative terminals being linked together by a conductor, an overcharge condition that results from continued battery charging after a battery cell is fully charged, a forced discharge condition that results from one of the battery cells reaching a minimum specified cell voltage, or an over temperature condition when any cell in the battery exceeds a predetermined temperature. These critical events can lead to safety issues and other issues that can harm the battery and/or the device being powered.

It would be beneficial to provide a device to isolate a battery from its powered device when a critical event occurs.

SUMMARY OF THE INVENTION

The present invention provides a current isolation contactor comprising a first contact; and a second contact linearly movable along an axis and rotationally movable around the axis between an engaged position with the first contact and a disengaged position away from the first contact. A spring is operatively coupled to the second contact. The spring is operable between a compressed position and an uncompressed position such that the second contact is in the engaged position when the spring is in the biased position and such that the second contact is in the disengaged position when the spring is in the unbiased position. A retaining pin retains the second contact in the engaged position. A drive system is operatively associated with retaining pin to move the retaining pin, allowing the second contact to move to the disengaged position.

Further, the present invention provides a current isolation contactor comprising a first contact and a second contact movable between an engaged position with the first contact and a disengaged position away from the first contact. A biasing member is coupled to the second contact. The biasing member is operable to move the second contact from the engaged position to the disengaged position. The contactor also includes a single-use drive system and a retaining pin operatively associated with the drive system and movable between an pin engagement position wherein the retaining pin retains the second contact in the engaged position and a pin release position wherein the retaining pin is moved upon operation of the drive system such that the biasing member biases the second contact to move to the disengaged position.

Additionally, the present invention provides a method comprising the steps of biasing a second contact into engagement with a first contact, the biasing including rotating the second contact relative to the first contact; inserting a pin into the second contact to maintain the first contact in electrical engagement with the second contact; and providing a drive mechanism in operative engagement with the pin, the drive mechanism being operable to move the pin, thereby allowing the first contact to disengage from the second contact.

BRIEF DESCRIPTION OF THE DRAWINGS

The foregoing summary, as well as the following detailed description of the invention, will be better understood when read in conjunction with the appended drawings. For the purpose of illustrating the invention, there is shown in the drawings certain embodiments of the present invention. It should be understood, however, that the invention is not limited to the precise arrangements and instrumentalities shown. In the drawings.

DETAILED DESCRIPTION OF THE PREFERRED EMBODIMENTS

Figure 1:
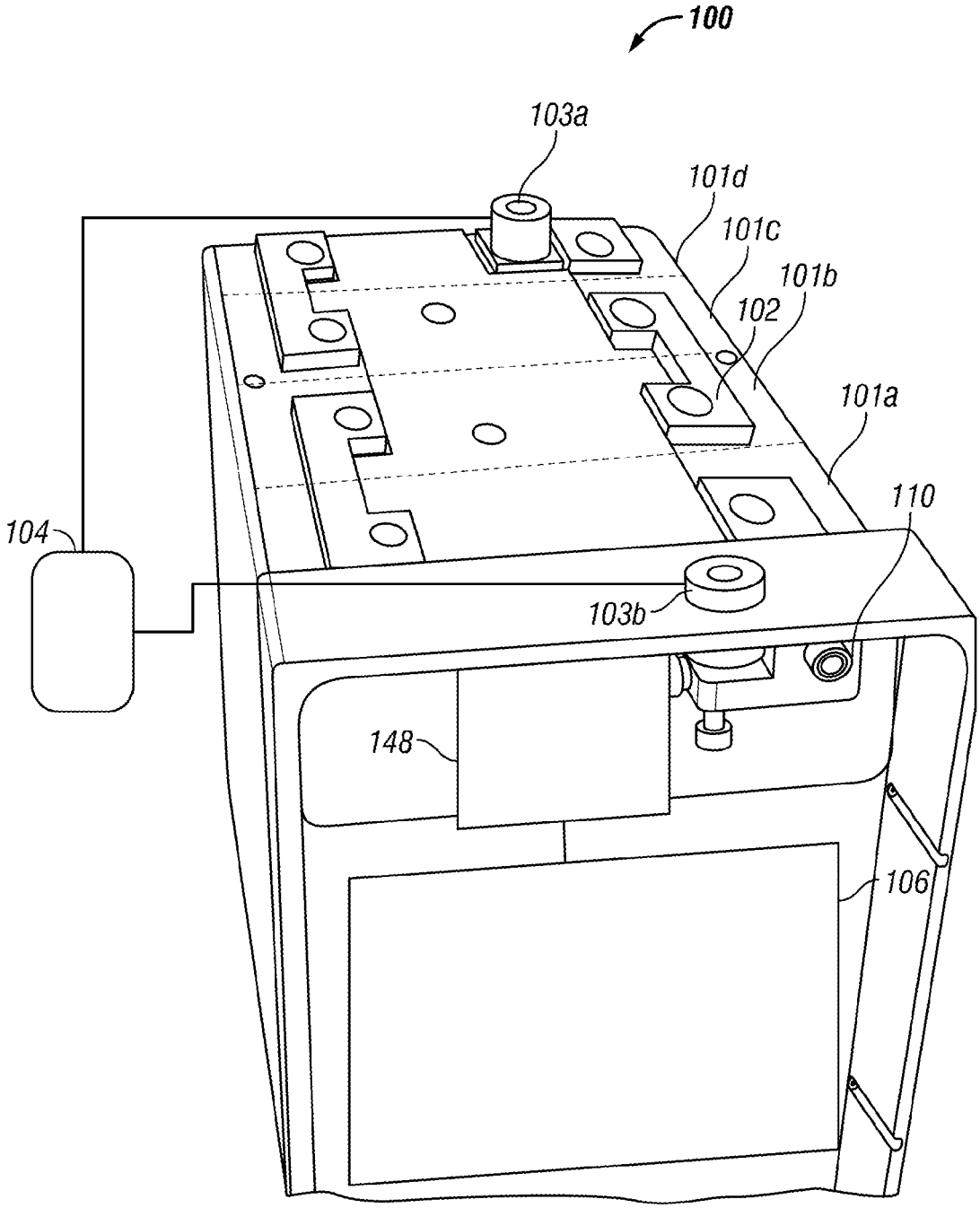
FIG. 1 is a side perspective view of a system including a device powered by a battery having a current isolation contactor according to an exemplary embodiment of the present invention.

In describing the embodiments of the invention illustrated in the drawings, specific terminology will be used for the sake of clarity. However, the invention is not intended to be limited to the specific terms so selected, it being understood that each specific term includes all technical equivalents operating in similar manner to accomplish similar purpose. As used herein, devices are "electrically engaged" with each other or are in "electrical engagement" with each other when a path is provided for a transfer of electrons between the devices. Similarly, devices are "electrically disengaged" from each other or are in "electrical disengagement" from each other when a path is not provided for a transfer of electrons between the devices. Also, a "battery" may be comprised of a single cell or multiple cells. It is understood that the drawings are not drawn to scale.

The following describes particular examples of embodiments of the present invention. It should be understood, however, that the invention is not limited to the embodiments detailed herein. Generally, the following disclosure refers to a current isolation contactor for an electrically operated device that quickly and efficiently separates two electrical contacts from each other, thus breaking an electrical circuit, in response to a critical event, in order to protect the device and the battery system powering the device.

Referring to the schematic drawing in FIG. 1, a battery system 100 includes a plurality of battery cells 101*a*, 101*b*, 101*c*, 101*d* (represented by dashed lines in FIG. 1) that are electrically engaged with each other in series to form a battery 102. Battery 102 is electrically engaged with a load 104, which is electrically powered by battery 102. Load 104 may be any electrically operated device that draws electrical power from battery system 100. Battery system 100 further includes a battery management system (BMS) 106 that manages battery 102. In an exemplary embodiment, battery system 100 may be a large capacity system, with the ability to generate about 1000 amps of current. BMS 106 includes a current isolation contactor 110 that is configured to electrically disengage battery 102 from load 104 as a result of a critical event. Those skilled in the art, however, will recognize that battery system 100 and current isolation contactor 110 are both scalable, meaning that a smaller isolation contactor 110 can be used for a smaller battery system 100 and a larger isolation contactor 110 can be used for a larger battery system 100.

Battery 102 includes a first terminal 103*a* that is directly connected to cell 101*d* and a second terminal 103*b* that is electrically engaged with cell 101*a* through current isolation contactor 110. Load 104 is electrically engaged to terminals 103*a*, 103*b* to form a closed electrical circuit when current isolation contactor 110 is closed.

Figure 2:
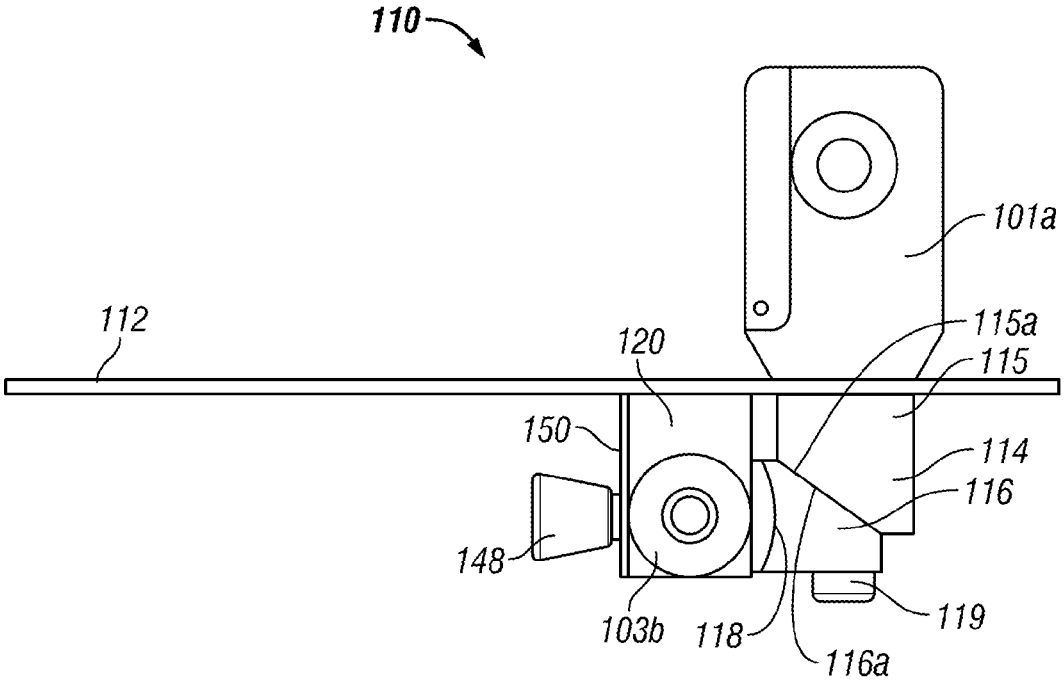
FIG. 2 is a top plan view of the current isolation contactor of FIG. 1 shown in a "contact-engaged" position.
Figure 3:
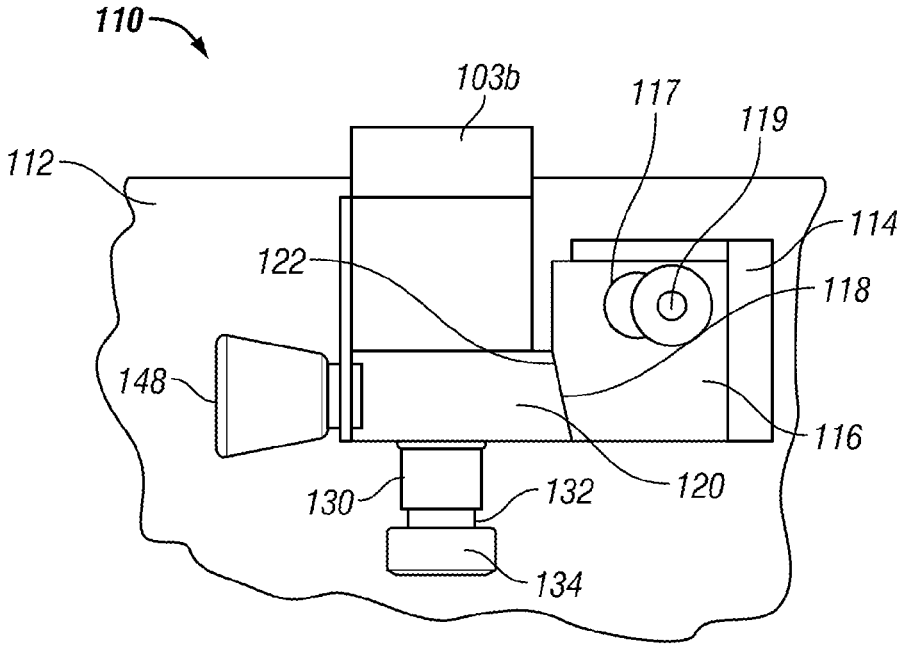
FIG. 3 is a side elevational view of the current isolation contactor of FIG. 2.
Figure 4:
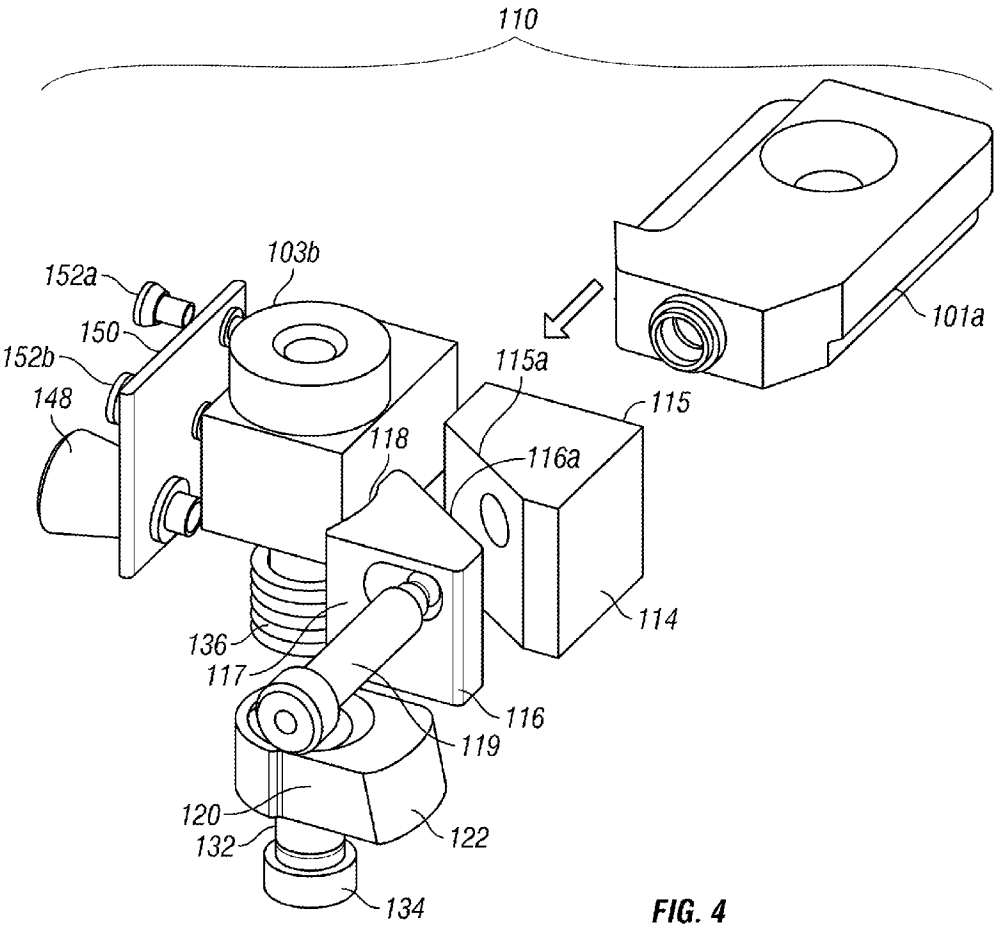
FIG. 4 is an exploded perspective view of the current isolation contactor of FIGS. 2 and 3.

As shown in FIGS. 2-4, a first exemplary embodiment of the current isolation contactor (contactor) 110 according to the present invention is shown. A first, or fixed, contact 114 is fixedly coupled to cell 101*a* through a housing 112. Fixed contact 114 includes a base 115 and a contact portion 116. Base 115 includes an oblique face 115*a* and contact portion 116 has a matching oblique face 116*a*. Contact portion 116 includes an oval through-hole 117, which allows oblique faces 115*a*, 116*a* to be adjustable to each other during manufacture to facilitate proper engagement with a second, or movable, contact 120. A bolt 119 extends through through-hole 117 and is used to secure base 115 with contact portion 116. Contact portion 116 has a fixed contact surface 118. In an exemplary embodiment, contact surface 118 is concave.

Movable contact 120 is located proximate to fixed contact 114. Movable contact 120 includes a movable contact surface 122 that is movable in and out of physical and electrical engagement with respect to fixed contact surface 118. In an exemplary embodiment, movable contact surface 122 is convex and is curved to engage the concave surface of fixed contact surface 118 along the entire concave surface. Each of fixed contact surface 118 and movable contact surface 122 are sufficiently large to transmit operating currents between each other without a significant increase in the temperature of fixed contact 114 or movable contact 120. Terminal 103*b*, fixed contact 114, and movable contact 120 are preferably constructed from copper or other suitable highly electrically conductive material to facilitate good electrical conduction between fixed contact 114 and terminal 103*b*.

In an exemplary embodiment, movable contact surface 122 may linearly move up to about 11 millimeters from fixed contact surface 118 so that movable contact surface 122 and fixed contact surface 118 are electrically disengaged from each other when movable contact surface 122 is disengaged from fixed contact surface 118. When movable contact surface 122 is in engagement with fixed contact surface 118, movable contact 120 is electrically engaged with terminal 103*b* and fixed contact 114, as illustrated in FIGS. 1-3 and 5. When movable contact surface 122 is disengaged from fixed contact surface 118, movable contact 120 is electrically disengaged from terminal 103*b* and fixed contact 114, as illustrated in FIG. 6. Terminal 103*b* is spaced sufficiently far away from fixed contact 114 so that electrical power cannot jump the gap between terminal 103*b* and fixed contact 114 when contactor 110 is in a disengaged position.

Referring to FIGS. 5, 7, 7A, and 8, movable contact 120 includes a passage 124 extending therethrough that is sized to allow movable contact 120 to be slidably mounted on a shaft 130 that extends from terminal 103*b* along a longitudinal axis $A_L$. Movable contact 120 further includes a helical groove 126 that communicates with passage 124. Helical groove 126 extends about 90 degrees around axis $A_L$. Movable contact 120 also includes a generally annular land 127 that extends around the top of passage 124.

Shaft 130 has a pin 135 that extends outwardly therefrom. Pin 135 is inserted into and engages helical groove 126 in movable contact so that movable contact 120 rotates about shaft 130 as movable contact slides along the length of shaft 130.

Shaft 130 includes a free end 132 located distal from terminal 103*b* and optionally includes a stopper 134 located at free end 132. Free end 132 may be separate from the remainder of terminal 103*b*, as shown in FIG. 4, to facilitate insertion of movable contact 120 over shaft 130 during manufacture of contactor 110. Free end 132 may be constructed from an electrically non-conducting material, such as, for example, nylon. Free end 132 may include external threads (not shown) that thread into shaft 130 to secure free end 132 to shaft 130. Free end 132 may be a screw, with the head of the screw acting as stopper 134. Stopper 134 restricts movable contact 120 from sliding off shaft 130. Alternatively, stopper 134 may be omitted from free end 132 so that, when movable contact 120 disengages from fixed contact 114, movable contact 120 falls off shaft 130. Shaft 130 also includes a pin engagement slot 133, shown in FIGS. 9 and 11, that is used to retain a retaining pin 146, as will be explained later herein.

Referring back to FIG. 5, a biasing member 136 is wrapped around shaft 130. In an exemplary embodiment, biasing member 136 may be a helical spring. Biasing member 136 is operable to bias movable contact 120 away from fixed contact 114 and terminal 103*b*. Biasing member 136 includes a first end 138 that is in engagement with terminal 103*b* and a second end 140 that is in engagement with land 127 on movable contact 120. Land 127 retains second end 140 of biasing member 136 on movable contact 120.

Figure 9:
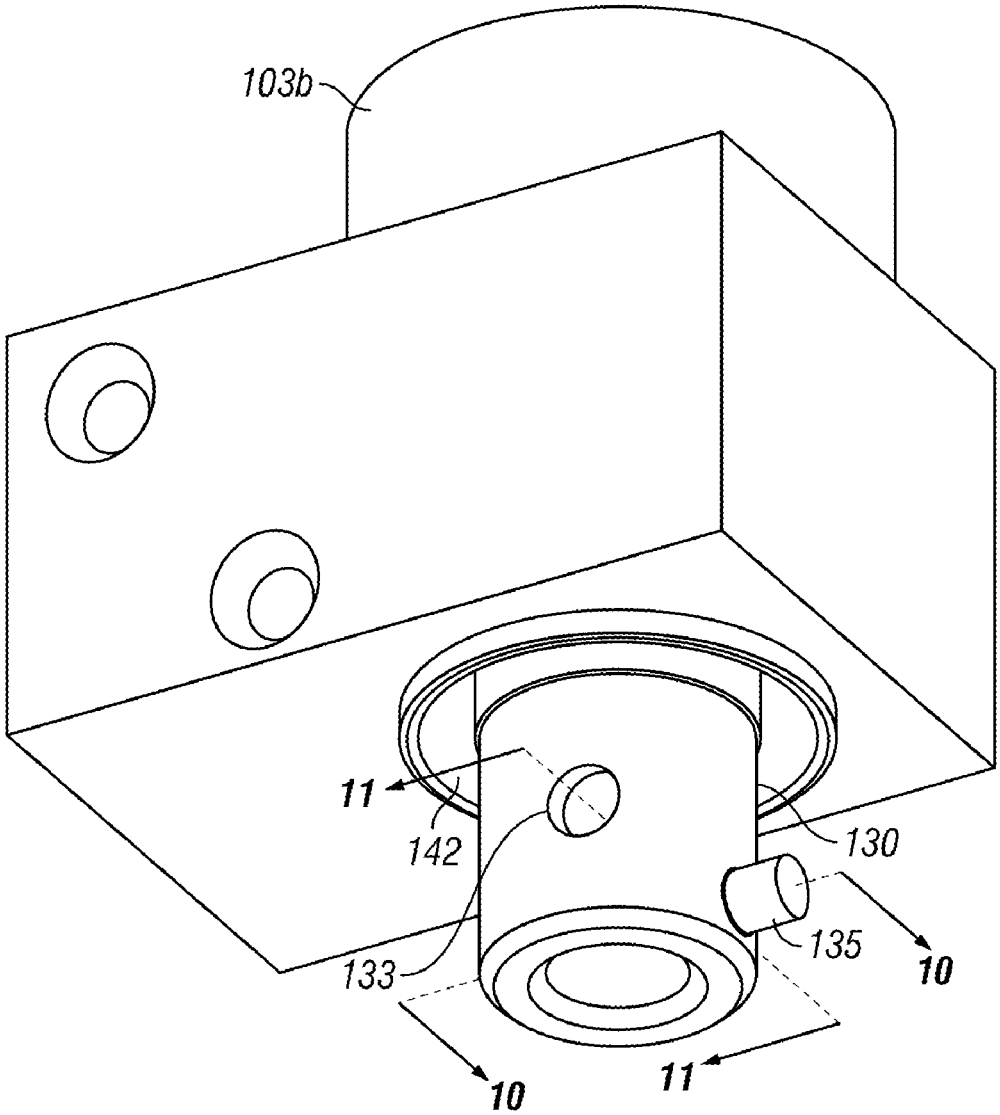
FIG. 9 is a bottom perspective view of a battery terminal used with the current isolation contactor of FIG. 1.
Figure 10:
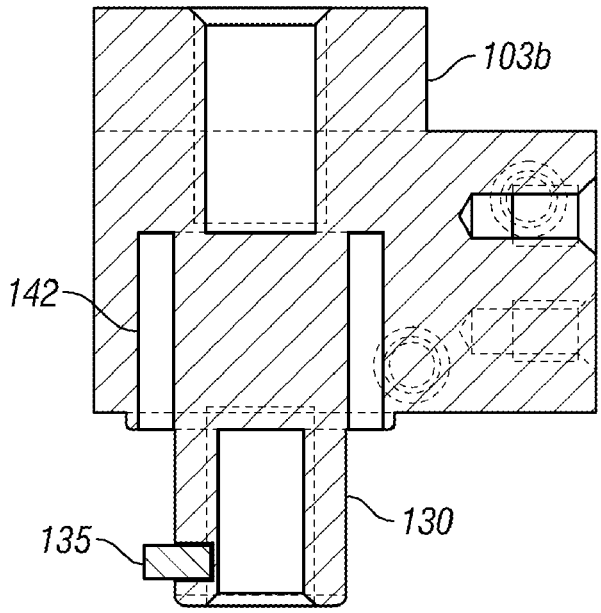
FIG. 10 is a front elevational view, in section of the battery terminal of FIG. 9, taken along lines 10-10 of FIG. 9.
Figure 11:
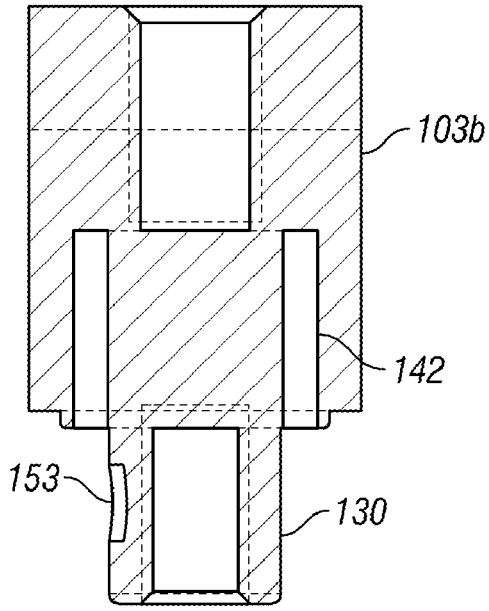
FIG. 11 is a side elevational view, in section of the battery terminal of FIG. 9, taken along lines 11-11 of FIG. 9.

Biasing member 136 compresses/extends along longitudinal axis $A_L$ such that movable contact 120 is in the engaged position with fixed contact 114 when biasing member 136 is in the compressed/biased position and movable contact 120 is in the disengaged position with respect to fixed contact 114 when biasing member 136 is in the uncompressed/unbiased position. Those skilled in the art will recognize that biasing member 136 may be not necessarily be fully uncompressed or unbiased and still be in the uncompressed/unbiased position as compared to the compressed/biased position. As shown in FIGS. 9-11, terminal 103*b* includes a cavity 142 that allows biasing member 136 to be recessed inside terminal 103*b* when biasing member 136 is in a compressed condition so that movable contact 120 engages both terminal 103*b* and fixed contact 114.

Figure 5:
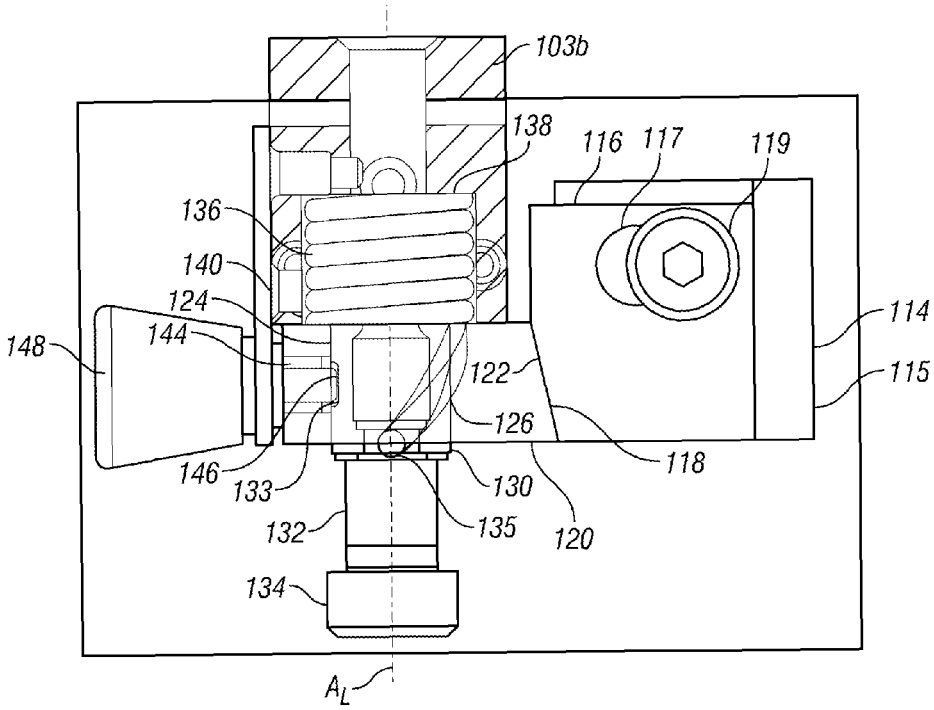
FIG. 5 is an enlarged side elevational view, partially in section, of the current isolation contactor of FIGS. 2 and 3.
Figure 6:
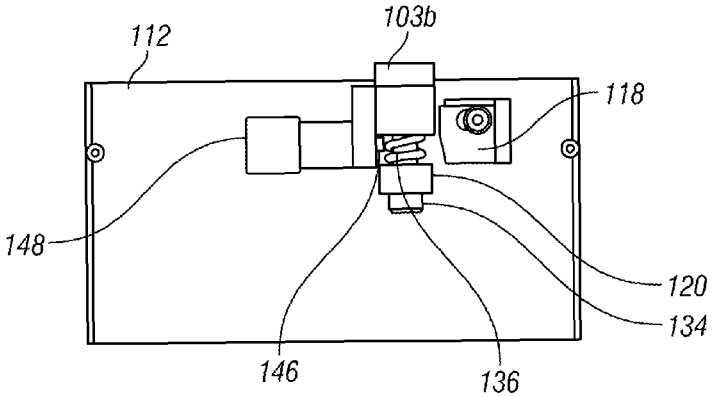
FIG. 6 is a side elevational view of the current isolation contactor of FIG. 1 shown in a "contact-disengaged" position.
Figure 7:
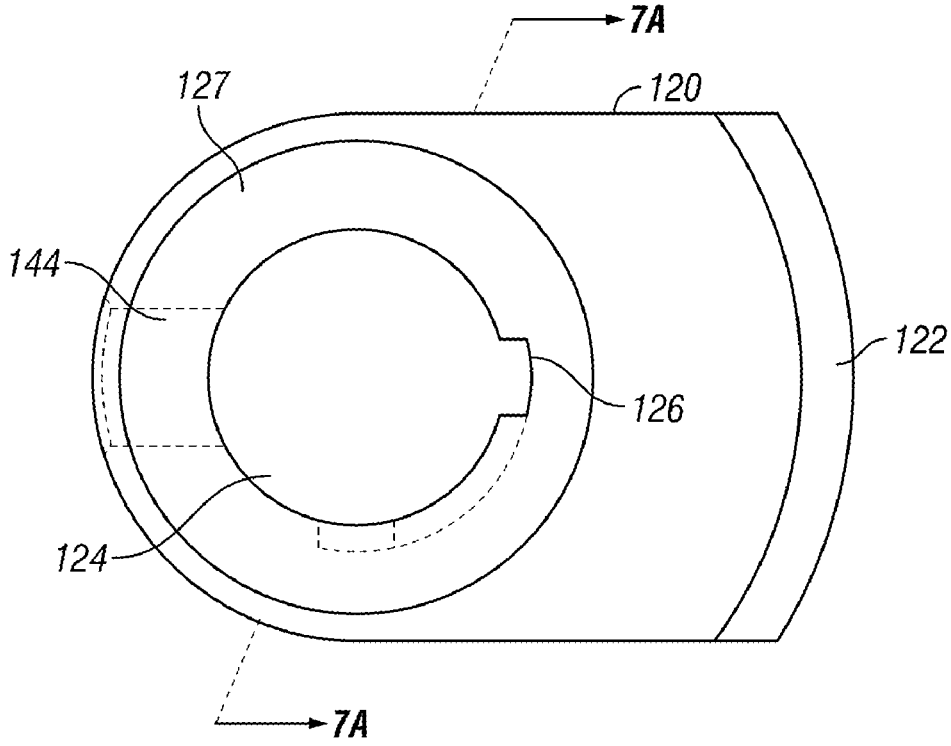
FIG. 7 is a top plan view of a movable contact used with the current isolation contactor of FIG. 1.
Figure 7A:
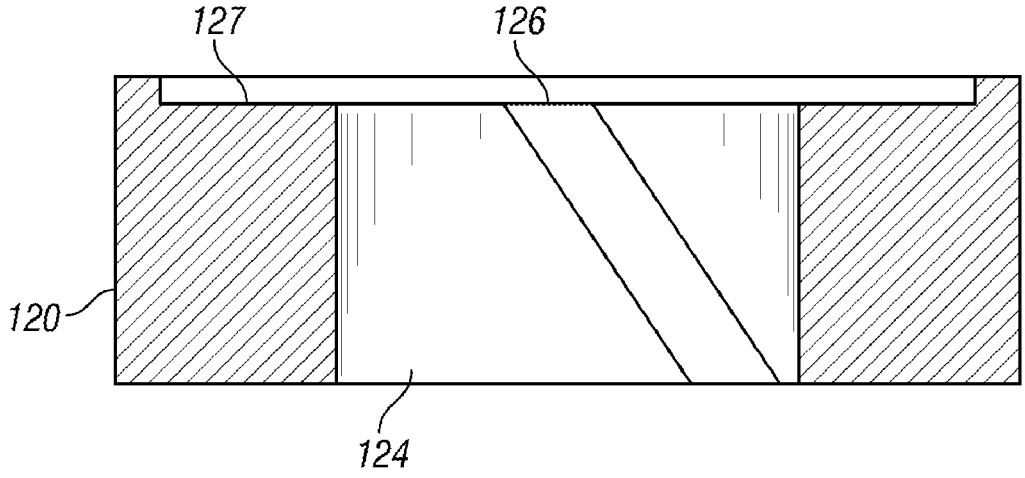
FIG. 7A is a sectional view of the movable contact of FIG. 7, taken along lines 7A-7A of FIG. 7.
Figure 8:
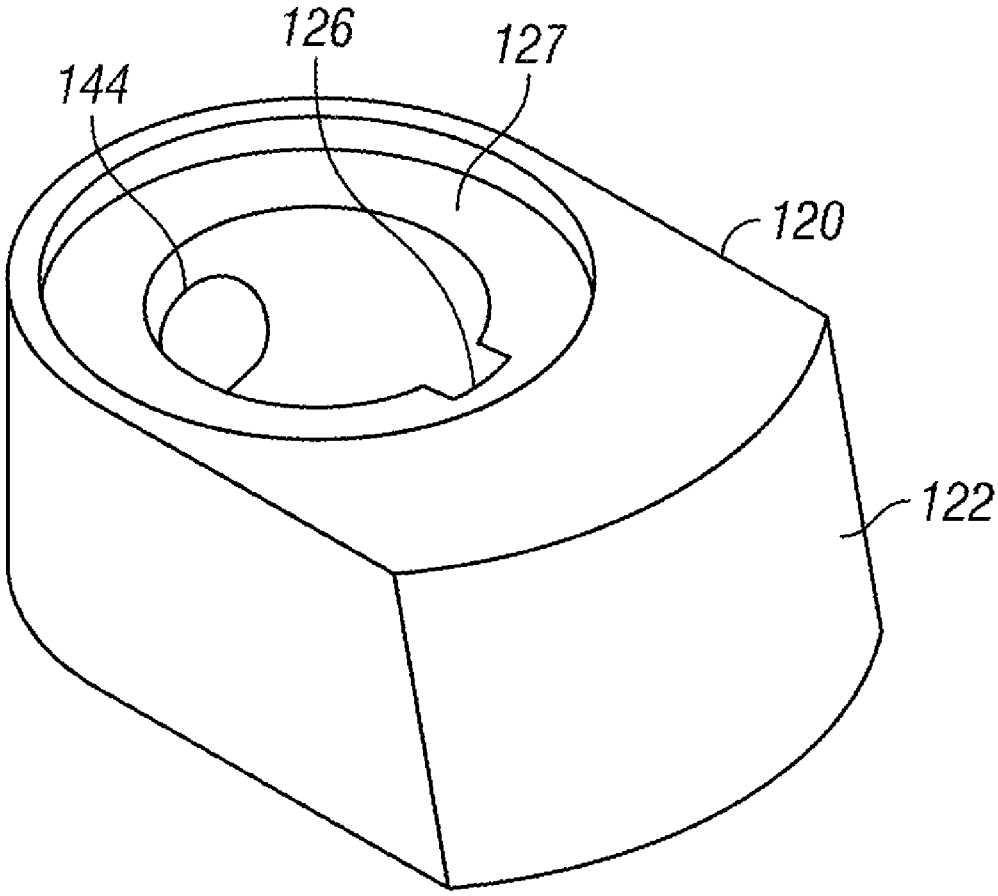
FIG. 8 is a perspective view of the movable contact of FIG. 7.

Referring back to FIGS. 7 and 8, movable contact 120 also includes a support retaining pin engagement passage 144 that is sized to allow for insertion and travel of a retaining pin 146, which is shown in FIG. 5.

A drive system 148 is located in housing 112 and is operatively engaged with retaining pin 146 such that, when movable contact 120 is in the biased position and is electrically engaged with fixed contact 114, retaining pin 146 extends through support retaining pin engagement passage 144 and into pin engagement slot 133 in shaft 130. In an exemplary embodiment, drive system 148 is a single-use system, and may be a pyrotechnic device, such as a pin puller device manufactured by Special Devices, Inc, located in Mesa, Ariz. For example, drive system 148 may be a 260 milligram zirconium-potassium perchlorate initiator, which produces about 2,000 pounds per square inch (psi), or about 138 bars, of pressure upon activation. Drive system 148 is attached to terminal 103*b* via a connecting plate 150. Connecting plate 150 may be coupled to terminal 103*b* via screws 152*a*, 152*b* and drive system 148 is in turn coupled to connecting plate 150 via screws (not shown).

Drive system 148 is used to pull retaining pin 146 from pin engagement slot 133 and support retaining pin engagement passage 144, thereby allowing biasing member 136 to move movable contact 120 from the biased position, in which movable contact 120 is physically and electrically engaged with fixed contact 114 and terminal 103*b*, to the unbiased position, in which movable contact 120 is physically and electrically disengaged from fixed contact 114 and terminal 103*b*, breaking the electrical circuit between battery 102 and load 104. Movable contact 120 linearly translates along shaft 130 and, due to the engagement of pin 135 with helical groove 126, movable contact 120 also rotationally translates about 90 degrees about shaft 130 and longitudinal axis $A_L$, further moving contact surface 122 of movable contact 120 away from contact surface 118 of fixed contact 114. The rotational translation of movable contact 120 restricts or limits movable contact 120 from re-engaging with fixed contact 114 after retaining pin 146 is pulled. The rotational translation increases the separation between fixed contact 114 and movable contact 120 and requires both pressure and rotation to re-engage movable contact 120 with fixed contact 114.

Drive system 148 is electrically coupled to BMS 106 (shown schematically in FIG. 1) such that, when BMS 106 receives a signal that a critical event is occurring or has occurred, BMS 106 transmits a signal to drive system 148 to activate drive system 148.

During manufacture of contactor 110, to set contactor 110 so that movable contact 120 is moved into engagement with fixed contact 114, movable contact 120 is rotated and linearly translated along shaft 130 such that support retaining pin engagement passage 144 in movable contact 120 is aligned with pin engagement slot 133 in shaft 130. Retaining pin 146 is inserted into support retaining pin engagement passage 144 and pin engagement slot 133 in shaft 130 such that movable contact 120 is prevented from rotating or linearly translating with respect to fixed contact 114.

As movable contact 120 is rotated and linearly translated into the position described above, biasing member 136 is forced into compression as movable contact 120 forms an electrical connection with fixed contact 114 and terminal 103*b*. In an exemplary embodiment, pressure exerted on fixed contact 114 by movable contact 120 is at least about 2,000 psi (about 138 bars). An even pressure is generally exerted across contact surface 118 of fixed contact 114 and contact surface 122 of movable contact 120.

When drive system 148 is not in operation, contactor 110 draws no power to maintain movable contact 120 in contact with fixed contact 114. To activate drive system 148, BMS 106 transmits an electrical signal to drive system 148, which activates the initiator in drive system 148 to pull retaining pin 146 and release movable contact 120, thereby allowing biasing member 136 to both rotate and linearly translate movable contact 120 along shaft 130 and out of physical end electrical engagement with fixed contact 114 and terminal 103*b*, breaking the electrical connection between battery system 100 and load 104. In an exemplary embodiment, the time from when BMS 106 detects a fault that requires movable contact 120 to be disconnected from fixed contact 114 to the time when movable contact 120 is actually disengaged from fixed contact 114 is less than about 150 milliseconds and, preferably, less than about 100 milliseconds.

The action of both rotating and linearly translating movable contact 120 away from fixed contact 114 provides two degrees of separation of movable contact 120 from fixed contact 114, reducing the possibility of movable contact 120 inadvertently contacting fixed contact 114, such as if battery system 100 is dropped or otherwise moved in a manner that could cause movable contact 120 to move after it is electrically disengaged from fixed contact 114.

Biasing member 136 is sufficiently strong that movable contact 120 may not be moved back into engagement with fixed contact 114 by hand while contactor 110 is still connected to battery system 100. After drive system 148 operates to disengage movable contact 120 from fixed contact 114, rather than reset contactor 110 in place inside housing 112, contactor 110 is preferably removed from housing 112 and replaced with a new contactor 110 in which movable contact 120 is engaged with fixed contact 114 and terminal 103*b*. To remove contactor 110, load 104 is disconnected from terminal 103*b*, drive system is disconnected from BMS 106, and contactor 110 (with terminal 103*b*) is disconnected from housing 112 by removing any securing devices such as bolt 119 (shown in FIG. 4) that is used to secure contactor 110 to cell 101*a* through housing 112. A replacement contactor 110 is then installed by reversing the process described above. The original contactor 110 may be reset by a technician using specialized tools (not shown) so that original contactor 110 can be reused in a future application.

While the principles of the invention have been described above in connection with preferred embodiments, it is to be clearly understood that this description is made only by way of example and not as a limitation of the scope of the invention.

What is claimed is:

1. A current isolation contactor comprising:

a first contact;

a second contact linearly movable along an axis and rotationally movable around the axis between an engaged position with the first contact and a disengaged position away from the first contact;

a spring operatively coupled to the second contact, the spring being operable between a compressed position and an uncompressed position such that the second contact is in the engaged position when the spring is in the biased position and such that the second contact is in the disengaged position when the spring is in the unbiased position;

a retaining pin retaining the second contact in the engaged position;

a drive system operatively associated with retaining pin to move the retaining pin, allowing the second contact to move to the disengaged position; and a shaft extending from the terminal along the axis, wherein the second contact is linearly and rotationally movable along the shaft.

2. The current isolation contactor according to claim 1, further comprising a terminal releasably engaged with the second contact when the second contact is engaged with the first contact and disengaged from the second contact when the second contact is disengaged from the first contact.

3. The current isolation contactor according to claim 1, wherein the wherein the shaft comprises a free end located distal from the terminal, and wherein a stopper is located at the free end.

4. The current isolation contactor according to claim 1, wherein the shaft comprises a helical rib extending thereal-ong.

5. The current isolation contactor according to claim 4, wherein the second contact comprises a slot, the slot engaging the helical rib such that the second contact rotates about 90 degrees around the axis as the second contact moves along the shaft between the engaged position and the disengaged position.

6. The current isolation contactor according to claim 1, wherein the retaining pin extends through the second contact and into the shaft.

7. The current isolation contactor according to claim 2, wherein the spring has a first end in engagement with the terminal and a second end in engagement with the second contact.

8. The current isolation contactor according to claim 1, wherein the drive system is configured to pull the retaining pin, thereby allowing the spring to move the second contact to the disengaged position.

9. The current isolation contactor according to claim 1, wherein the drive system comprises a pyrotechnic device configured to pull the retaining pin away from the second contact.

10. A current isolation contactor comprising:

a first contact;

a second contact movable between an engaged position with the first contact and a disengaged position away from the first contact;

a biasing member coupled to the second contact, the biasing member operable to move the second contact from the engaged position to the disengaged position;

a single-use drive system; and a retaining pin operatively associated with the drive system and movable between an pin engagement position wherein the retaining pin retains the second contact in the engaged position and a pin release position wherein the retaining pin is moved upon operation of the drive system such that the biasing member biases the second contact to move to the disengaged position;

wherein when the second contact is in the engaged position, the second contact is engaged with a battery terminal.

11. The current isolation contactor according to claim 10, wherein the biasing member is located between the second contact and the terminal.

12. The current isolation contactor according to claim 10, wherein the retaining pin extends through the second contact and into the terminal.

13. The current isolation contactor according to claim 10, wherein, when the second contact moves between the engaged position and the disengaged position, the second contact translates linearly about and axis and rotatably about the axis.

14. The current isolation contactor according to claim 10, wherein the first contact comprises a base having a first oblique face and a contact portion having a second oblique face in contact with the first oblique face, wherein the contact portion is adjustable relative to the base.

15. A current isolation contactor comprising:

a first contact;

a second contact movable between an engaged position with the first contact and a disengaged position away from the first contact;

a biasing member coupled to the second contact, the biasing member operable to move the second contact from the engaged position to the disengaged position;

a single-use drive system; and a retaining pin operatively associated with the drive system and movable between an pin engagement position wherein the retaining pin retains the second contact in the engaged position and a pin release position wherein the retaining pin is moved upon operation of the drive system such that the biasing member biases the second contact to move to the disengaged position;

wherein the biasing member is located between the second contact and the terminal.

* * * * *